US010615019B2

(12) United States Patent
Hirano

(10) Patent No.: US 10,615,019 B2
(45) Date of Patent: Apr. 7, 2020

(54) ELECTRON MULTIPLIER FOR MASS SPECTROMETER

(71) Applicant: Agilent Technologies, Inc., Santa Clara, CA (US)

(72) Inventor: Kazushi Hirano, Tokyo (JP)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 14/571,701

(22) Filed: Dec. 16, 2014

(65) Prior Publication Data

US 2015/0187550 A1 Jul. 2, 2015

(30) Foreign Application Priority Data

Dec. 27, 2013 (JP) ..... 2013-273542

(51) Int. Cl.
*H01J 49/02* (2006.01)
*H01J 43/30* (2006.01)
*H01J 43/26* (2006.01)

(52) U.S. Cl.
CPC ..... *H01J 49/025* (2013.01); *H01J 43/26* (2013.01); *H01J 43/30* (2013.01)

(58) Field of Classification Search
None
See application file for complete search history.

(56) References Cited

U.S. PATENT DOCUMENTS 2,815,453 A 12/1957 Colson et al.
3,003,065 A 10/1961 Ketchledge
3,898,456 A * 8/1975 Dietz ..... G01T 1/29 250/299
5,374,827 A * 12/1994 Roy ..... H01J 37/244 250/283

(Continued)

FOREIGN PATENT DOCUMENTS

CN 102460636 A 5/2012
DE 4105376 A1 9/1991

(Continued)

OTHER PUBLICATIONS

Japanese Office action dated Aug. 22, 2017 from related Japanese Application No. 2013273542.

*Primary Examiner* — Andrew Smyth

(57) ABSTRACT

A secondary electron multiplier includes: a conversion dynode for emitting a secondary electron in response to an incident ion; a plurality of dynodes configured to have multi-stages from second to final stages for receiving the secondary electron; and a first voltage applying device for applying a first negative voltage to the conversion dynode and sequentially dividing the first negative voltage to apply to each of the second-stage and subsequent dynodes, wherein the secondary electron multiplier is configured to sequentially multiply the emitted secondary electron by the second-stage and subsequent dynodes. In the secondary electron multiplier, any of the second-stage and subsequent dynodes have a second voltage applying device for applying (Continued)

a second negative voltage. The secondary electron multiplier has an improved ion detection efficiency without a large reduction of a usable period thereof, thereby enhancing the sensitivity of a mass spectrometer.

19 Claims, 9 Drawing Sheets

(56) References Cited

U.S. PATENT DOCUMENTS

| | | | | |
|---|---|---|---|---|
| 8,735,818 | B2 * | 5/2014 | Kovtoun | H01J 43/30 250/336.1 |
| 9,316,625 | B2 * | 4/2016 | Fujita | H01J 49/025 |
| 2002/0195556 | A1 * | 12/2002 | Yoshinari | H01J 49/04 250/283 |
| 2004/0232835 | A1 | 11/2004 | Keller et al. | |
| 2012/0175514 | A1 * | 7/2012 | Izumi | H01J 43/30 250/281 |
| 2015/0219607 | A1 * | 8/2015 | Fujita | H01J 49/025 250/288 |
| 2015/0325420 | A1 * | 11/2015 | Collings | H01J 49/025 250/282 |

FOREIGN PATENT DOCUMENTS

| | | | | |
|---|---|---|---|---|
| EP | 2447979 | A1 | | 2/2012 |
| JP | H05325888 | A | | 12/1993 |
| JP | H07142024 | A | | 6/1995 |
| JP | 2000311649 | A | * | 11/2000 |
| JP | 2000311649 | A | * | 11/2000 |
| JP | 3154831 | B2 | | 4/2001 |
| JP | 201054364 | A | | 3/2010 |
| JP | 2013524444 | A | | 6/2013 |
| WO | 2002086944 | A1 | | 10/2002 |
| WO | 2010150301 | A1 | | 12/2010 |
| WO | WO 2014045360 | A1 | * | 3/2014 |

* cited by examiner

ELECTRON MULTIPLIER FOR MASS SPECTROMETER

RELATED APPLICATIONS

This application claims the benefit under 35 U.S.C. 119 of Japanese Patent Application No. 2013-273542, filed Dec. 27, 2013, titled "ELECTRON MULTIPLIER FOR MASS SPECTROMETER," the content of which is incorporated by reference herein in its entirety.

TECHNICAL FIELD

The present invention relates to a secondary electron multiplier used for an ion detector of a mass spectrometer, in particular to a secondary electron multiplier capable of improvements in the sensitivity of a mass spectrometer.

BACKGROUND

FIG. 4 is a schematic view showing a basic concept of an exemplary inductively-coupled plasma mass spectrometer (hereinafter, also referred to simply as instrument) 11. The instrument 11 has a plasma torch 20 for generating plasma 22, an interface section 30 placed at a position facing the plasma 22, an ion lens section 50 placed behind the interface section 30, an ion guide section 70 placed behind the ion lens section 50, and an ion separation section 80 placed behind the ion guide section 70.

The plasma torch 20 has a coil 21 for generating a high frequency electromagnetic field near its tip, and is placed under atmospheric pressure. The coil 21 is connected to an RF power source (not illustrated). In the plasma torch 20, the high frequency electromagnetic field generated by the coil 21 produces high frequency inductively-coupled plasma 22 under atmospheric pressure. In the plasma torch 20, an atomized sample (not illustrated) is introduced into the plasma 22 from the front of the plasma torch 20. The introduced sample (not illustrated) is vaporized and decomposed by the action of the plasma 22; and in cases of large majority of elements, they are finally converted into ions. The ionized sample (not illustrated) is contained in the plasma 22.

Ions in the plasma 22 pass through a sampling cone 31 and a skimmer cone 33 of the interface section 30, and only positive ions are extracted in the form of an ion beam by a first electrode 53 and a second electrode 54 forming an extraction electrode section of the ion lens section 50. Then, the ion beam is guided into a collision/reaction cell 71 of the ion guide section 70. The ion beam guided into the collision/reaction cell 71 is induced to a subsequent stage along a track determined by an electric field generated by a multipole electrode (e.g., an octapole structure) 73. Further, a collision/reaction gas may be introduced from a feeding port 72 into the collision/reaction cell 71, and polyatomic ions or interference ions that cause interferences in mass spectra are removed from the ion beam. During operation of the instrument 11, the interior of the interface section 30 is sucked by a rotary pump RP, the interiors of the ion lens section 50 and the ion guide section 70 are sucked by a turbo molecular pump (TMP 1), and the interior of the ion separation section 80 described below is sucked by a turbo molecular pump (TMP 2).

The ion beam having passed through the collision/reaction cell 71 is introduced into a mass analyzer (generally, a quadrupole mass analyzer or a quadrupole mass filter) 81 of the ion separation section 80. Ions in the ion beam are separated based on the mass-to-charge ratio, and separated ions are guided and detected in an ion detector 82. Detection signals are computed by a signal processing section 90 and analytical values of an element to be measured in a sample are obtained.

The ion detector 82 may generally be a secondary electron multiplier capable of detecting an imperceptible ion stream with high precision. For example, a secondary electron multiplier is disclosed in Patent Document 1 (Japanese Patent Laid-Open Publication No. H5-325,888). A secondary electron multiplier utilizes a property, which emits secondary electrons by collision of ions with a metal surface or a surface of specially-treated ceramic. The emitted secondary electrons are accelerated by an electric field, further subjected to repeated collisions, and thereby they are exponentially amplified. In general, secondary electrons can be amplified in the order of about $10^3$ to about $10^8$. As a material for emission of secondary electrons, a metal such as Al or Cu—Be alloy with an oxidized surface, ceramic or the like may be used. FIG. 5 schematically shows a construction of an exemplary secondary electron multiplier 10 of conventional art. The secondary electron multiplier 10 shown in FIG. 5 is generally called as a secondary electron multiplier of multiple-stage dynode type, having a structure where a plurality of electrodes called as dynodes are aligned to face one another. In FIG. 5, an exemplary construction with 10-stage dynode is shown, but a construction with about 20 or more stages may be generally used. A first dynode is called as a conversion dynode to convert an ion to an electron. Therefore, when a secondary electron multiplier 10 is used as an ion detector 82 in a mass spectrometer shown in FIG. 4, ions having passed through the mass analyzer 81 collide with a surface of this conversion dynode dy1. Second and subsequent dynodes mainly work to amplify secondary electrons. Finally, multiplied electrons are detected at a final stage (e.g., anode in FIG. 5) and output to the signal processing section 90.

At the signal processing section 90, a signal can be measured by two kinds of method. One is a method for obtaining the number of ions having reached the ion detector by counting current pulses of amplified electrons (pulse counting method); and the other is a method for obtaining a value proportional to the number of ions having reached to the ion detector by measuring a current of amplified electrons as a DC value (current measurement method).

A high negative voltage −V is applied to the conversion dynode dy1 by a power source 85. In a standard secondary electron multiplier, about −1500 V to about −3500 V may be applied to the conversion dynode dy1. Therefore, the power source 85 has a variable output voltage, and a control signal from, for example, a controller (not illustrated) enables the control of the output voltage. As shown in FIG. 5, dynodes dy1 to dy10 and an anode are connected in series via respective resistors $R_1$ to $R_{11}$. To each of a dynode dy2 at a second stage to dy10 and the anode, a voltage sequentially divided by each of resistors $R_1$ to $R_{11}$ is applied. In a secondary electron multiplier of high energy dynode type (not illustrated), a voltage of about −10 kV may be applied to a conversion dynode at a first stage.

It is probable that the yield of ion/electron conversion at the first-stage dynode dy1 exerts a critical influence on the efficiency of ion detection. It is generally known that the yield of ion/electron conversion statistically follows Poisson distribution. Assuming that the mean yield is 1, about 37% of ions incident in a secondary electron multiplier do not emit even one electron. As a result, no output signal is output from the secondary electron multiplier. However, if the mean yield is increased to 3, the amount of ions that emit no electron decreases to about 5% of the entire ions, resulting in increased efficiency of ion detection. The improvement of ion detection efficiency by this increase of ion/electron conversion yield provides an increase in the measurement sensitivity in both of the pulse counting method and the current measurement method. Further, the ion/electron conversion yield correlates with a kinetic energy of incident ions, that is a first dynode voltage, and a higher ion kinetic energy can provide a higher conversion yield.

FIG. 7 shows the relationship between the voltage applied to a first dynode dy1 and the ion detection sensitivity. A graph of FIG. 7 shows measurement results of lithium (7u), yttrium (89u) and thallium (205u) by changing voltages to be applied to the first dynode dy1 under the condition where the secondary electron multiplier has a constant amplification gain in an ICP mass spectrometer 7700× manufactured by Agilent Technologies, Inc. In the case of lithium having a low mass number, there is almost no increase in the sensitivity. It is observed that an element having a larger mass number has a larger increase in the sensitivity. This is because the difference in the ion mass number leads to a difference in the ion/electron conversion efficiency characteristic on the voltage applied to the first dynode dy1. In the case of an element having a low mass number, it is inferred that the ion/electron conversion efficiency is not so much increased even by decreasing a voltage to the first dynode dy1.

It is commonly known that a secondary electron multiplier gradually decays with the use thereof, and its amplification gain also gradually decreases. Therefore, the decreased amplification gain can be recovered by further reducing a negative voltage applied to the first dynode dy1 (increasing an absolute value of the voltage). However, an excessive increase of the voltage between dynodes saturates the emission of secondary electrons from the dynodes, so there is a limit on the recovery of the amplification gain. FIG. 6 shows a typical example indicating the relationship between the electron energy and the secondary electron emission.

For example, FIG. 8 is a drawing wherein voltages of each dynode are plotted when a usable period of a standard secondary electron multiplier is divided, for example, into three stages, "initial," "middle" and "final." It shows that when the amplification gain is kept constant, a negative voltage applied to the first dynode dy1 is decreased in a step-by-step manner along with the deterioration of the secondary electron multiplier. FIG. 8 is prepared based on the premise that the secondary electron multiplier has 10 stages of dynodes, and up to −2500 V can be applied to the first dynode dy1. In order to increase the ion detection efficiency in such electron multiplier, a case where a negative voltage to be applied to the first dynode dy1 is lower than an ordinary voltage (larger in the absolute value of voltage) is premised. FIG. 9 shows a drawing wherein voltages of each dynode in such case are plotted. As shown in FIG. 9, a voltage applied to the first stage at "initial" is reduced from an ordinary value, about −1500 V (FIG. 8) to about −2000 V; at "middle," from about −2000 V (FIG. 8) to about −2250 V (at "final," remaining at about −2500 V). In comparison with the case of FIG. 8, this case cannot provide a sufficient voltage margin required for recovering a reduction of amplification gain caused by the deterioration of a secondary electron multiplier by reducing a negative voltage applied to the first dynode dy1. Therefore, a secondary electron multiplier of this case shortens its usable period (lifetime). Further, in a secondary electron multiplier of high energy dynode type (not illustrated), a high negative voltage (e.g., about −10 kV) is applied to a conversion dynode dy1, so the ion/electron conversion yield at the first dynode dy1 is higher in comparison with a standard secondary electron multiplier. However, since the voltage to a second dynode dy2, which affects the amplification gain of a secondary electron multiplier, is usually about −2000 V, an incident energy of electrons to the dynode dy2 is too high and consequently, it is considered highly probable that a considerable amount of current pulse signal is lost due to this dynode dy2.

Therefore, there is a need for improving the ion detection efficiency of a secondary electron multiplier without a large reduction of a usable period of thereof, and consequently increasing the sensitivity of a mass spectrometer.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

One embodiment of the present invention provides a secondary electron multiplier, which comprises: a conversion dynode for emitting a secondary electron in response to an incident ion; a plurality of dynodes configured to have multi-stages from second to final stages for receiving the secondary electron; and a first voltage applying device for applying a first negative voltage to the conversion dynode and sequentially dividing the first negative voltage to apply to each of the second-stage and subsequent dynodes, wherein the secondary electron multiplier is configured to sequentially multiply the emitted secondary electron by the second-stage and subsequent dynodes. In the secondary electron multiplier, any of the second-stage and subsequent dynodes have a second voltage applying device for applying a second negative voltage.

Further, according to another embodiment of the present invention, the first voltage applying device may have a power source for generating the first negative voltage and a resistance for serially and sequentially connecting each dynode. Furthermore, a dynode, to which the second negative voltage is applied, may be any of second- to fifth-stages. The first negative voltage and the second negative voltage may be adjustable. Further, the second negative voltage is changed thereby to increase or decrease a secondary electron emission efficiency at the second negative voltage-applied dynode and subsequent dynodes. Then, the second negative voltage may be reduced to recover a reduction of amplification gain caused by the deterioration of the secondary electron multiplier. Further, the first negative voltage may be reduced to increase an ion/electron conversion yield.

Another embodiment of the present invention provides a method for increasing an amplification gain of a secondary electron multiplier comprising a conversion dynode for emitting a secondary electron in response to an incident ion, and a plurality of dynodes configured to have multi-stages from second to final stages for receiving the secondary electron, wherein the secondary electron multiplier is configured: to apply a first negative voltage to the conversion dynode and sequentially divide the first negative voltage to apply to each of the second-stage and subsequent dynodes; and to sequentially multiply the emitted secondary electron by the second-stage and subsequent dynodes. The method includes: reducing the first negative voltage to increase an ion/electron conversion yield; and applying a second negative voltage to any of the second-stage and the subsequent dynodes in a controllable manner to increase a secondary electron emission efficiency at the second-stage and subsequent dynodes.

According to another embodiment of the present invention, a dynode, to which the second negative voltage is applied, may be any of second- to fifth-stage dynodes. Also, the method may include reducing the second negative voltage to recover a reduction of amplification gain caused by the deterioration of the secondary electron multiplier.

Advantages of the Invention

The present invention improves the ion detection efficiency of a secondary electron multiplier without a reduction of a usable period thereof, and consequently, it can increase the sensitivity of a mass spectrometer.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
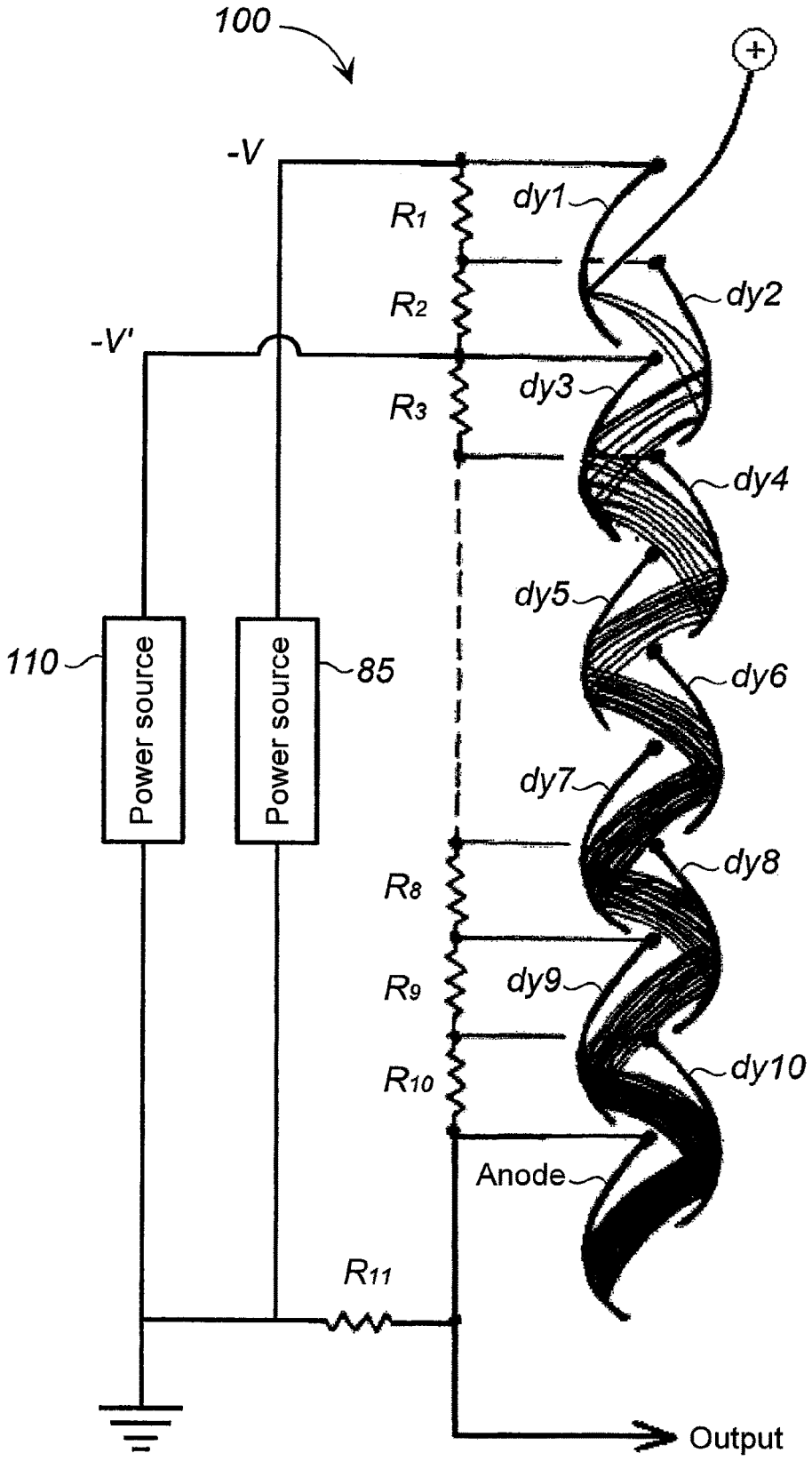
FIG. 1 is a schematic view showing an exemplary construction of a secondary electron multiplier according to the present invention.
Figure 5:
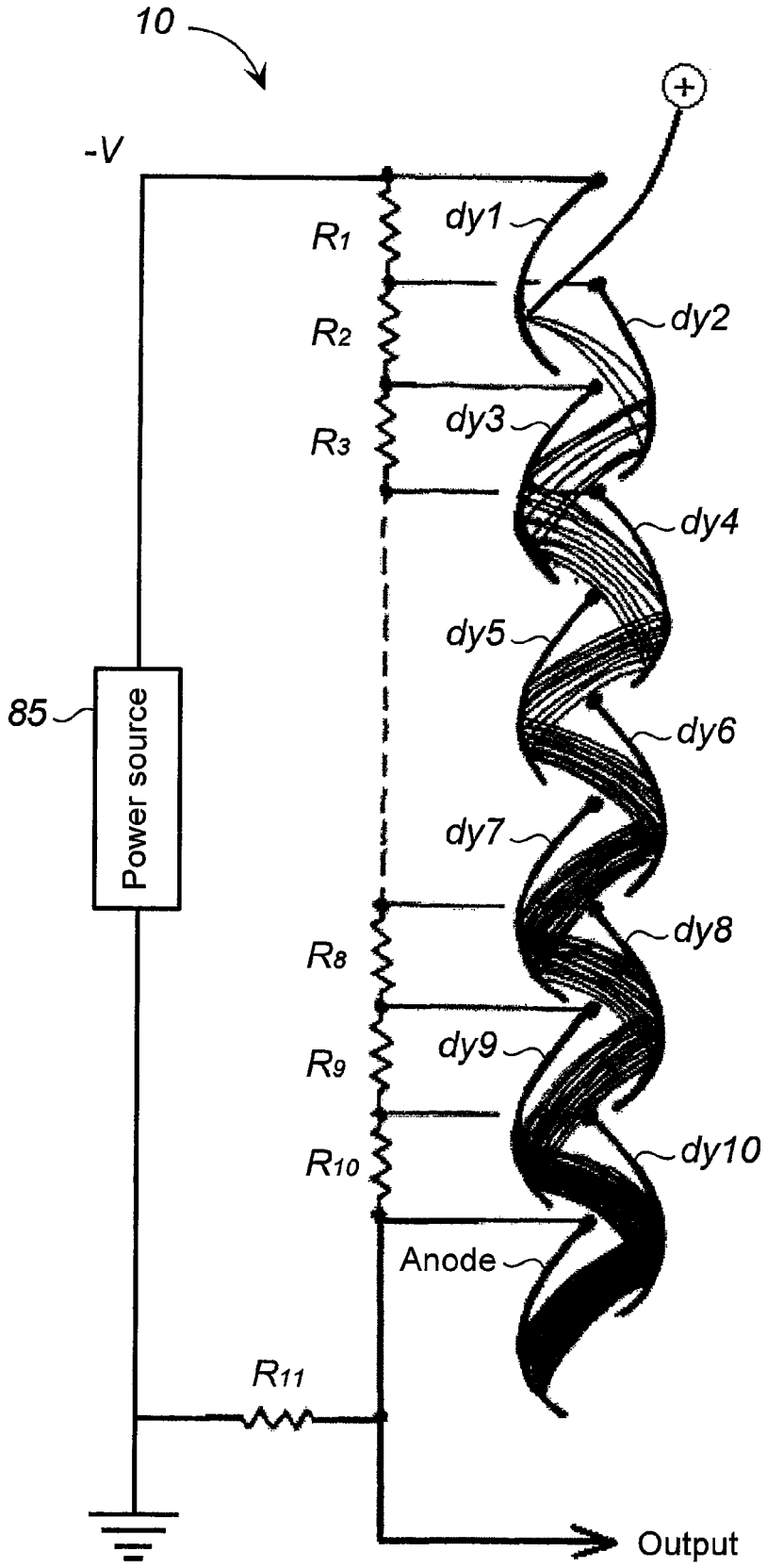
FIG. 5 is a schematic view of a construction of an exemplary secondary electron multiplier of conventional art.
Figure 6:
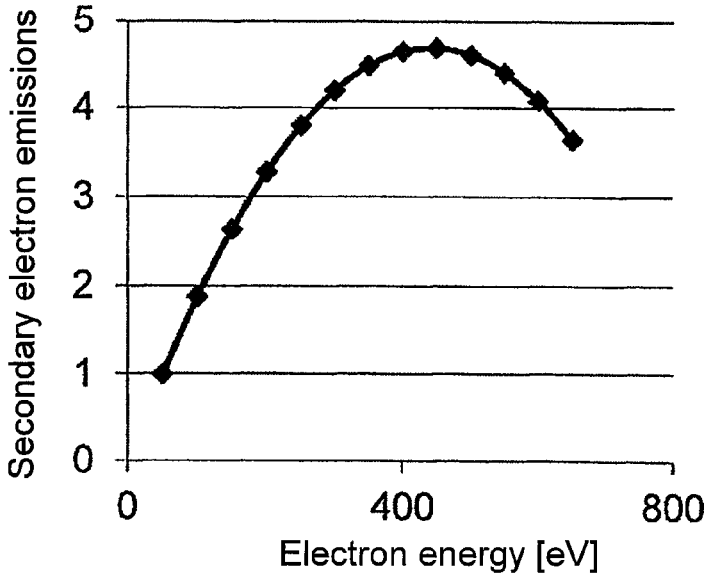
FIG. 6 is a graph indicating the relationship between the electron energy and the secondary electron emission of a dynode.
Figure 7:
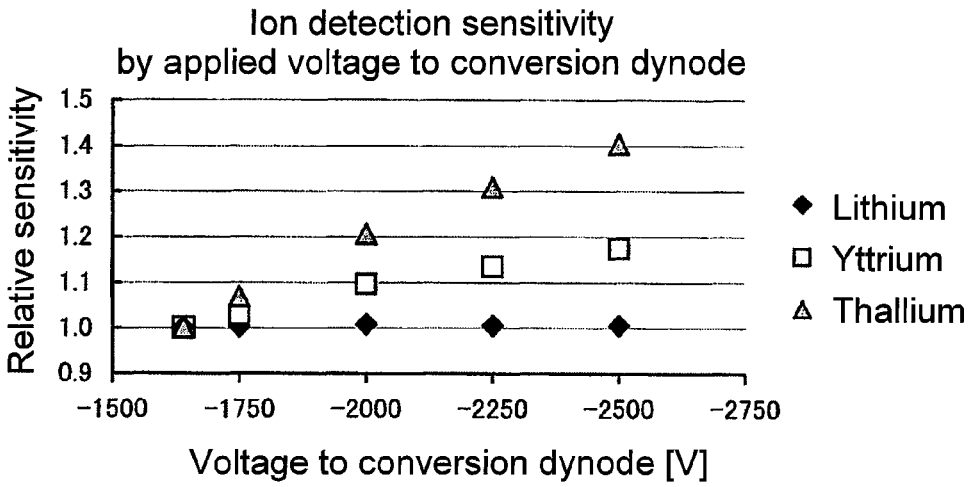
FIG. 7 is a graph indicating the relationship between the voltage applied to a conversion dynode and the ion detection sensitivity.

Embodiments of the present invention are explained in detail by referring to the accompanying drawings. FIG. 1 schematically shows an exemplary construction of a secondary electron multiplier 100 according to the present invention. A significant difference between this secondary electron multiplier 100 and the above-described conventional secondary electron multiplier 10 (FIG. 5) is that the secondary electron multiplier 100 includes a first voltage applying device and a second voltage applying device. The first voltage applying device may be configured for applying a first negative voltage to the conversion dynode and sequentially dividing the first negative voltage to apply to each of the second-stage and subsequent dynodes. The first voltage applying device may include a first power source 85, and a resistance for serially and sequentially connecting each dynode. The second voltage applying device may be configured for applying a second negative voltage to any of the second-stage and subsequent dynodes. The second voltage applying device may include a second power source 110. The constituent elements as in above-mentioned FIG. 5 are denoted by the same reference numerals to omit explanations of the same constituent elements.

In FIG. 1, the secondary electron multiplier 100 of the present invention has the second power source 110 separately from the first power source 85. The second power source 110 can be controlled by a control signal from a controller (not illustrated) in the same manner as the first power source 85, and a voltage output from the second power source 110 may be variable. For example, the second power source 110 may output a voltage in the range from about −500 V to about −3000 V, preferably from about −800 V to about −2500 V. A (second) negative voltage −V' output from the second power source 110 may be applied to a third dynode dy3 of the secondary electron multiplier 100 independently of divided voltages from the first power source 85. Alternatively, the negative voltage output from the second power source 110 may be applied to not the third dynode dy3 of the secondary electron multiplier but a second dynode dy2, a fourth dynode dy4, or a dynode adjacent thereto (e.g., dy5). Hereafter, explanation will be made on the assumption that the negative voltage −V' from the second power source 110 is applied to the third dynode dy3.

As described above, the negative voltage −V' from the second power source 110 in the secondary electron multiplier 100 of the present invention is applied to the third dynode dy3 independent of the first negative voltage −V applied to the first dynode dy1. When the negative voltage −V' is applied to the third dynode dy3, the voltage of dynode dy3 is changed and the voltages of second and subsequent dynodes can be changed. Therefore, in the secondary electron multiplier 100, the negative voltage −V applied to the first dynode dy1 controls the ion/electron conversion efficiency, the difference between the negative voltages −V and −V' controls the electron emission efficiency at the second and third dynodes dy2 and dy3, and the negative voltage −V' controls the electron emission efficiency at fourth and subsequent dynodes, eventually enabling an increase of amplification gain of the secondary electron multiplier 100. For example, when the voltage of the dynode dy3 is decreased (becomes larger in the absolute value), the secondary electron emissions of fourth and subsequent dynodes are increased, and eventually the amplification gain of the secondary electron multiplier 100 is increased. This signifies that a reduction of the negative voltage −V' can recover the amplification gain that has been decreased by the deterioration of the secondary electron multiplier 100.

As described in the BACKGROUND, there has been a drawback of shortening a usable period of a secondary electron multiplier as a consequence when a negative voltage to be applied to the first dynode dy1 is more reduced (increased in terms of the absolute value of voltage) than an ordinary voltage in order to enhance the ion detection efficiency of the secondary electron multiplier. However, according to the present invention, most of amplification gain of the secondary electron multiplier 100 can be controlled, as described above, by the voltage −V' of the third dynode dy3 independently of the voltage −V of the first dynode. Therefore, even when the secondary electron multiplier 100 of the present invention is used at a negative voltage −V applied to the first dynode dy1 lower than the ordinary voltage since an early stage of its use, a reduction of amplification gain caused by the deterioration of the secondary electron multiplier 100 can be recovered by decreasing the voltage −V' of the third dynode dy3. Accordingly, the secondary electron multiplier 100 of the present invention can increase the ion detection efficiency without a large decrease of usable period. When this secondary electron multiplier 100 of the present invention is used for an ion detector of a mass spectrometer, the sensitivity of the mass spectrometer can be enhanced as a result.

Figure 2:
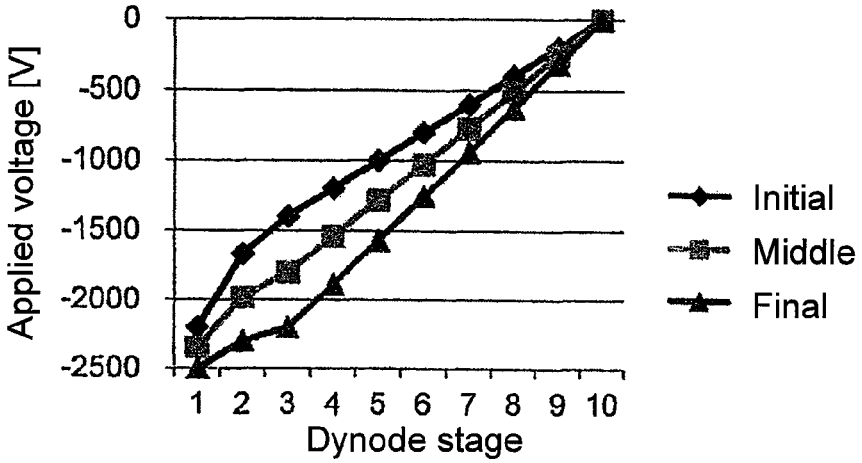
FIG. 2 is a graph indicating voltages of each dynode of the secondary electron multiplier constructed according to the present invention.
Figure 8:
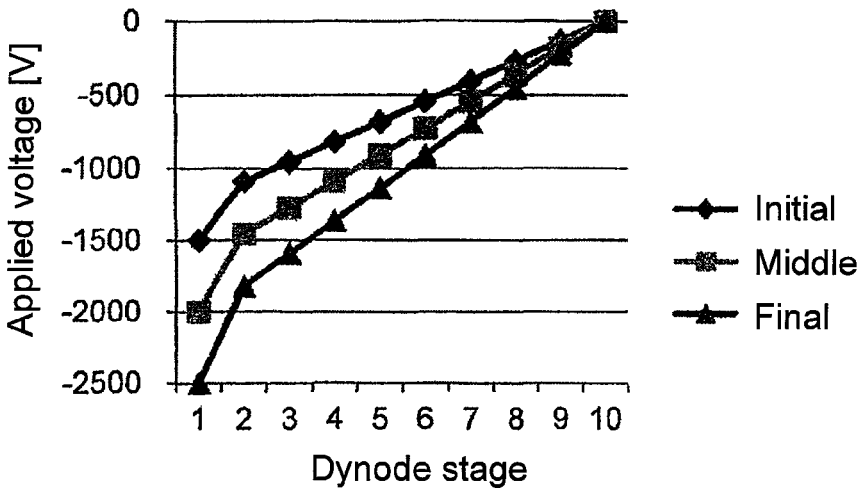
FIG. 8 is a drawing wherein voltages of each dynode of a standard secondary electron multiplier of conventional art are plotted.
Figure 9:
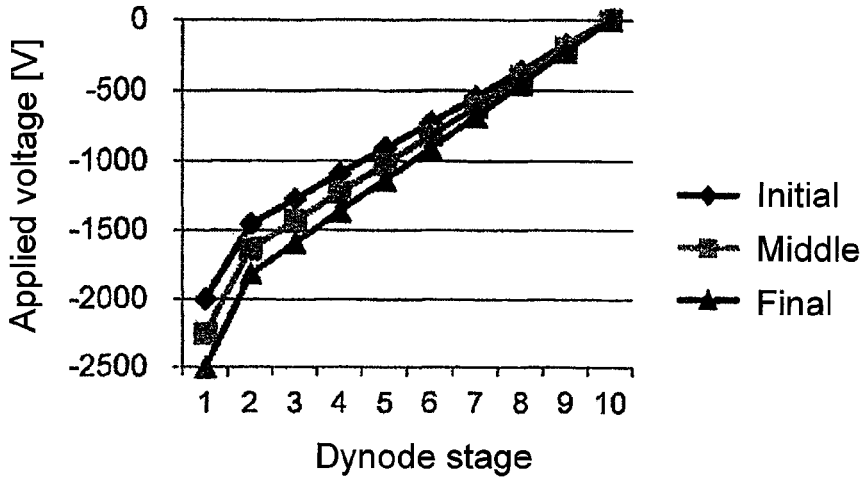
FIG. 9 is a drawing wherein voltages of each dynode are plotted when a negative voltage to be applied to a first dynode is lower (larger in the absolute value of voltage) than an ordinary voltage.

For example, FIG. 2 is a graph, in which voltages of each dynode are plotted when a usable period of a standard secondary electron multiplier, to which the present invention is applied, is divided into three stages of "initial," "middle" and "final." Like FIGS. 8 and 9, FIG. 2 is also drawn on the assumption that the secondary electron multiplier 100 has 10 stages of dynodes. In FIG. 2, an "initial" or "middle" negative voltage applied to the first dynode dy1 is reduced by about 400 V to about 750 V in comparison with a case for a conventional standard secondary electron multiplier (e.g., FIG. 8). That is, the ion detection efficiency of the secondary electron multiplier 100 of the present invention is more increased than that of a conventional one. At the same time, application of the negative voltage −V' to the third dynode dy3 can largely change voltages between the dynodes subsequent to the dy3 from the initial to the final stages, and enables a long-term recovery of amplification gain, which has been decreased by the deterioration of the secondary electron multiplier 100.

Thus, in one non-limiting embodiment, a method for increasing an ion detection efficiency of a secondary electron multiplier includes: applying a first negative voltage to a conversion dynode of the secondary electron multiplier, the conversion dynode configured for emitting a secondary electron in response to an incident ion, wherein the secondary electron multiplier comprises a plurality of dynodes configured to have multi-stages from second to final stages for receiving the secondary electron; sequentially dividing the first negative voltage to apply to each of the second-stage and subsequent dynodes, wherein the secondary electron multiplier is configured for sequentially multiplying the emitted secondary electron by the second-stage and subsequent dynodes; reducing the first negative voltage to increase an ion/electron conversion yield; and applying a second negative voltage to any of the second-stage and the subsequent dynodes in a controllable manner to increase or decrease a secondary electron emission efficiency at mid-stage and subsequent dynodes.

The present invention may be applied to a secondary electron multiplier of high-energy dynode type, for example, wherein a voltage of about −10 kV may be applied to a first dynode. In this case, a second negative voltage may be applied to a fourth dynode dy4. Alternatively, the second negative voltage to be applied may be applied to not the fourth dynode dy4 but a third dynode dy3 or a fifth dynode dy5; or it may be applied to 10th dynode when such secondary electron multiplier has about 20 stages of dynodes.

Figure 3:
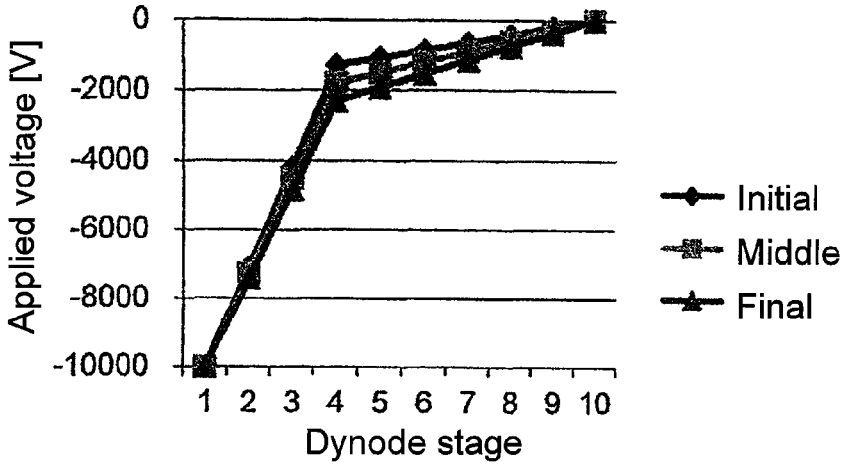
FIG. 3 is a graph indicating voltages of each dynode of the secondary electron multiplier of high energy dynode type, to which the present invention is applied.
Figure 4:
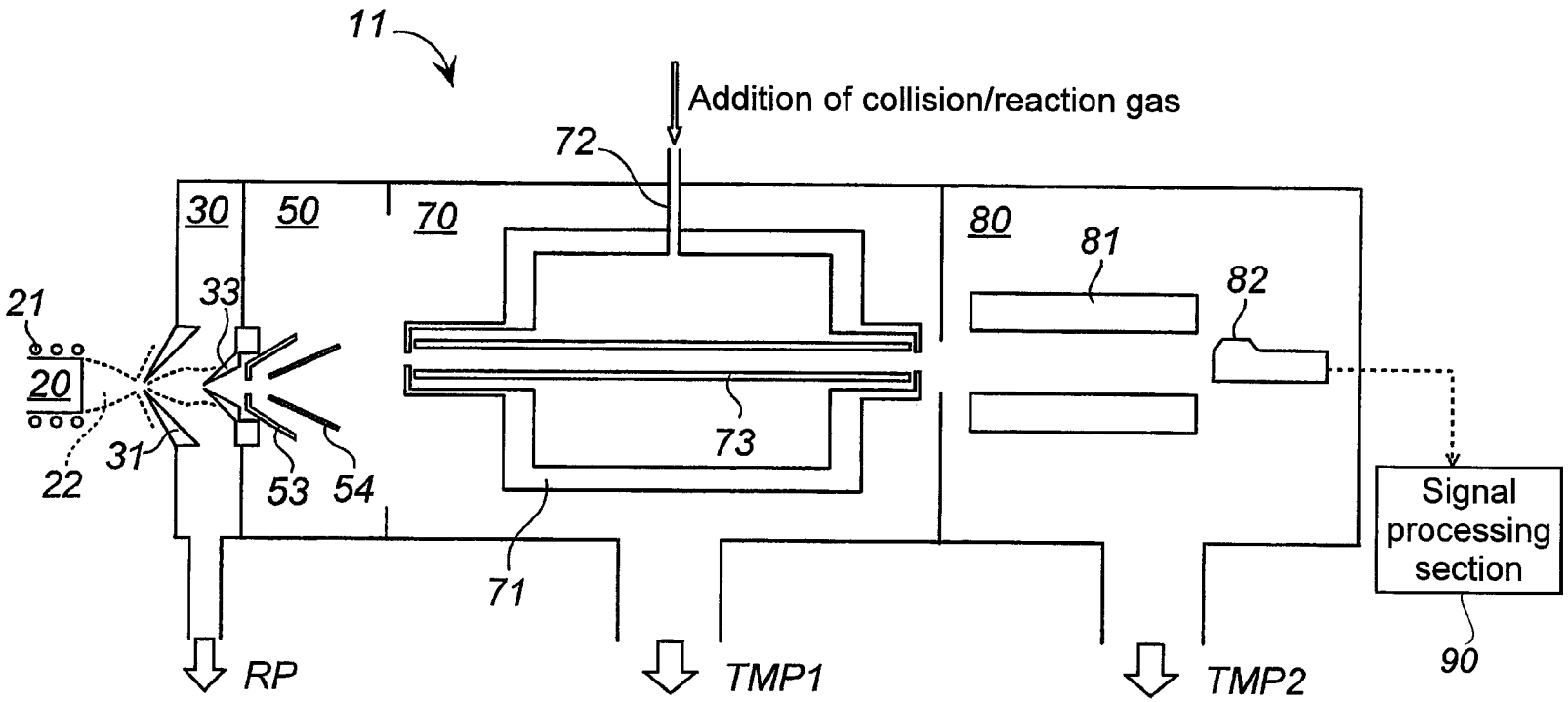
FIG. 4 is a schematic view showing a basic concept of an exemplary inductively-coupled plasma mass spectrometry.

FIG. 3 is a graph, in which voltages of each dynode are plotted in the same manner as in FIG. 2, pertaining to a secondary electron multiplier of high-energy dynode type, to which the present invention is applied. The figure is drawn on the assumption that such secondary electron multiplier has 10 stages of dynodes. In this case, the second negative voltage is applied to a fourth dynode dy4. The ion/electron conversion efficiency at a first dynode is extremely high due to the above-described advantage of a secondary electron multiplier of high-energy dynode type. Then, the first signal amplification section with an extremely low applied voltage (extremely large in the absolute value) and fourth and subsequent signal amplification sections are connected via three stages of dynodes. Thus, the electron accelerating voltage therebetween is dispersed and the secondary electron emission efficiency or the electron amplification efficiency from second to fourth dynodes is not as much reduced as that of a conventional secondary electron multiplier of high-energy dynode type. Therefore, the ion detection efficiency can be enhanced. This advantageous effect is also expected on an element having a low mass number, on which it has been difficult to enhance the sensitivity even in comparison with a standard secondary electron multiplier. Further, the negative voltage −V' applied to the fourth stage may be used to increase or decrease an amplification gain of the secondary electron multiplier in the same manner as the applied voltage to the second stage in a conventional secondary electron multiplier of high-energy dynode type.

DESCRIPTION OF REFERENCE NUMERALS

10, 100 Secondary electron multiplier
11 Mass spectrometry
82 Ion detector
85, 110 Power source
90 Signal processing section It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for increasing an ion detection efficiency of a secondary electron multiplier, the method comprising the steps of:

applying a first negative voltage from a first voltage applying device to a conversion dynode of the secondary electron multiplier to set an amplification gain of the electron multiplier, the conversion dynode configured for emitting a secondary electron in response to an incident ion, wherein the secondary electron multiplier comprises a plurality of dynodes configured to have multi-stages from second to final stages for receiving the secondary electron;

sequentially dividing the first negative voltage to apply to each of the second-stage and subsequent dynodes, wherein the secondary electron multiplier is configured for sequentially multiplying the emitted secondary electron by the second-stage and subsequent dynodes;

applying a second negative voltage from a second voltage applying device separate from the first voltage applying device to independently bias a second negative voltage-applied dynode, wherein the second negative voltage-applied dynode is any of the second-stage and the subsequent dynodes; and subsequent to the applying the first negative voltage and the applying the second negative voltage, changing the first negative voltage applied to the same conversion dynode to increase an ion/electron conversion yield, by increasing an absolute value of the first negative voltage applied to the same conversion dynode; and changing the second negative voltage in a controllable manner that increases a secondary electron emission efficiency at the second negative voltage-applied dynode and a dynode subsequent thereto, and recovers from a reduction of the amplification gain caused by deterioration of the electron multiplier, by increasing an absolute value of the second negative voltage.

2. The method according to claim 1, wherein the second negative voltage-applied dynode is any of second- to fifth-stage dynodes of the plurality of dynodes.

3. The method according to claim 1, wherein the second negative voltage-applied dynode is a third-stage dynode of the plurality of dynodes.

4. A secondary electron multiplier, comprising:

a conversion dynode for emitting a secondary electron in response to an incident ion;

a plurality of dynodes configured to have multi-stages from second to final stages for receiving the secondary electron;

a first voltage applying device configured for applying a first negative voltage to the conversion dynode and sequentially dividing the first negative voltage to apply to each of the second-stage and subsequent dynodes, the secondary electron multiplier being configured to sequentially multiply the emitted secondary electron by the second-stage and subsequent dynodes; and a second voltage applying device separate from the first voltage applying device and configured for:

applying a second negative voltage to independently bias a second negative voltage-applied dynode, wherein the second negative voltage-applied dynode is any of the second-stage and subsequent dynodes; and changing the second negative voltage to increase a secondary electron emission efficiency at the second negative voltage-applied dynode and a dynode subsequent thereto, and recover from a reduction of the amplification gain caused by deterioration of the electron multiplier, by increasing an absolute value of the second negative voltage.

5. The secondary electron multiplier according to claim 4, wherein the second negative voltage-applied dynode is any of second- to fifth-stage dynodes of the plurality of dynodes.

6. The secondary electron multiplier according to claim 4, wherein the second negative voltage-applied dynode is a third-stage dynode of the plurality of dynodes.

7. The secondary electron multiplier according to claim 4, wherein the first voltage applying device is configured for changing the first negative voltage to increase an ion/electron conversion yield, by increasing an absolute value of the first negative voltage.

8. A secondary electron multiplier, comprising:

a conversion dynode for emitting a secondary electron in response to an incident ion;

a plurality of dynodes configured to have multi-stages from second to final stages for receiving the secondary electron;

a first voltage applying device configured for:

applying a first negative voltage to the conversion dynode and sequentially dividing the first negative voltage to apply to each of the second-stage and subsequent dynodes, the secondary electron multiplier being configured to sequentially multiply the emitted secondary electron by the second-stage and subsequent dynodes; and changing the first negative voltage to increase an ion/electron conversion yield, by increasing an absolute value of the first negative voltage; and a second voltage applying device separate from the first voltage applying device and configured for:

applying a second negative voltage to independently bias a second negative voltage-applied dynode, wherein the second negative voltage-applied dynode is any of the second-stage and subsequent dynodes; and changing the second negative voltage to increase a secondary electron emission efficiency at the second negative voltage-applied dynode and a dynode subsequent thereto, and recover from a reduction of the amplification gain caused by deterioration of the electron multiplier, by increasing an absolute value of the second negative voltage.

9. The secondary electron multiplier according to claim 8, wherein the second negative voltage-applied dynode is any of second- to fifth-stage dynodes of the plurality of dynodes.

10. The secondary electron multiplier according to claim 8, wherein the second negative voltage-applied dynode is a third-stage dynode of the plurality of dynodes.

11. The method according to claim 1, wherein the second negative voltage-applied dynode is a fourth-stage dynode of the plurality of dynodes.

12. The method according to claim 1, wherein the second negative voltage-applied dynode is a fifth-stage dynode of the plurality of dynodes.

13. The method according to claim 1, wherein a difference between the first negative voltage and the second negative voltage controls the electron emission efficiency at the second negative voltage-applied dynode.

14. The secondary electron multiplier according to claim 4, wherein the second negative voltage-applied dynode is a fourth-stage dynode of the plurality of dynodes.

15. The secondary electron multiplier according to claim 4, wherein the second negative voltage-applied dynode is a fifth-stage dynode of the plurality of dynodes.

16. The secondary electron multiplier according to claim 4, wherein a difference between the first negative voltage and the second negative voltage controls the electron emission efficiency at the second negative voltage-applied dynode.

17. The secondary electron multiplier according to claim 8, wherein the second negative voltage-applied dynode is a fourth-stage dynode of the plurality of dynodes.

18. The secondary electron multiplier according to claim 8, wherein the second negative voltage-applied dynode is a fifth-stage dynode of the plurality of dynodes.

19. The secondary electron multiplier according to claim 8, wherein a difference between the first negative voltage and the second negative voltage controls the electron emission efficiency at the second negative voltage-applied dynode.

* * * * *